US010173762B1

(12) United States Patent
Gray

(10) Patent No.: US 10,173,762 B1
(45) Date of Patent: Jan. 8, 2019

(54) TROLLING MOTOR MOUNTING ASSEMBLY

(71) Applicant: Sammy Gray, Tishomingo, OK (US)

(72) Inventor: Sammy Gray, Tishomingo, OK (US)

( * ) Notice: Subject to any disclaimer, the term of this patent is extended or adjusted under 35 U.S.C. 154(b) by 0 days.

(21) Appl. No.: 15/703,565

(22) Filed: Sep. 13, 2017

(51) Int. Cl.
*B63H 20/08* (2006.01)
*B63H 20/06* (2006.01)
*B63H 20/00* (2006.01)

(52) U.S. Cl.
CPC ..... *B63H 20/06* (2013.01); *B63H 20/08* (2013.01); *B63H 20/007* (2013.01)

(58) Field of Classification Search
CPC ..... B63H 20/06; B63H 20/08; B63H 20/007
USPC ..... 248/640, 642, 643, 646, 651, 652, 653
See application file for complete search history.

(56) References Cited

U.S. PATENT DOCUMENTS 2,748,743 A * 6/1956 Shogran ..... B63H 20/08 114/271
3,861,628 A * 1/1975 Krieger ..... B63H 20/007 248/642
3,954,080 A * 5/1976 Weaver ..... B63H 20/007 440/55
4,129,088 A * 12/1978 Foley, Jr. ..... B63H 20/007 248/640
4,154,417 A * 5/1979 Foley, Jr. ..... B63H 20/007 248/640
4,555,233 A * 11/1985 Klammer ..... B63H 20/007 440/53
4,708,670 A 11/1987 Peters
4,875,656 A * 10/1989 Boede ..... B63H 20/007 248/642
4,966,566 A 10/1990 Baird
5,116,267 A 5/1992 Olson
6,468,117 B1 * 10/2002 Healey ..... B63H 21/213 114/144 E
6,808,431 B1 10/2004 Neely
7,510,450 B1 * 3/2009 Dresher ..... B63H 5/125 248/231.31
D594,034 S 6/2009 Bemloehr et al.
8,814,129 B2 8/2014 Todd et al.
8,936,498 B1 1/2015 Lee
2002/0102888 A1 * 8/2002 Pasley ..... B63H 20/007 440/6
2002/0152940 A1 10/2002 King
2007/0232157 A1 * 10/2007 Lee ..... B63H 20/007 440/6
2010/0116967 A1 * 5/2010 Todd ..... B63H 20/007 248/642

* cited by examiner

*Primary Examiner* — Muhammad Ijaz

(57) ABSTRACT

A trolling motor mounting assembly for pivotally mounting a trolling motor includes a base that is configured to couple to a boat. A connector, which is hingedly coupled to a first end of the base, is configured to selectively couple to a shaft of a trolling motor. A first fastener is coupled to the connector. A bar is hingedly coupled to the base proximate to a second end of the base. A second fastener is coupled to a second endpoint of the bar. An actuator is coupled to the bar and is operationally coupled to the second fastener. The bar can position the second fastener to couple to the first fastener to fixedly vertically position the shaft. The actuator can compel the second fastener to decouple from the first fastener. The bar and the connector can pivot so that the shaft is parallel to the base and the bar.

14 Claims, 5 Drawing Sheets

TROLLING MOTOR MOUNTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to mounting assemblies and more particularly pertains to a new mounting assembly for pivotally mounting a trolling motor.

BRIEF SUMMARY OF THE INVENTION

An embodiment of the disclosure meets the needs presented above by generally comprising a base that is configured to couple to a boat. A connector, which is hingedly coupled to a first end of the base, is configured to selectively couple to a shaft of a trolling motor. A first fastener is coupled to the connector. A bar is hingedly coupled to the base proximate to a second end of the base. A second fastener is coupled to a second endpoint of the bar. An actuator is coupled to the bar and is operationally coupled to the second fastener. The bar can position the second fastener to couple to the first fastener to fixedly vertically position the shaft. The actuator can compel the second fastener to decouple from the first fastener. The bar and the connector can pivot so that the shaft is parallel to the base and the bar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
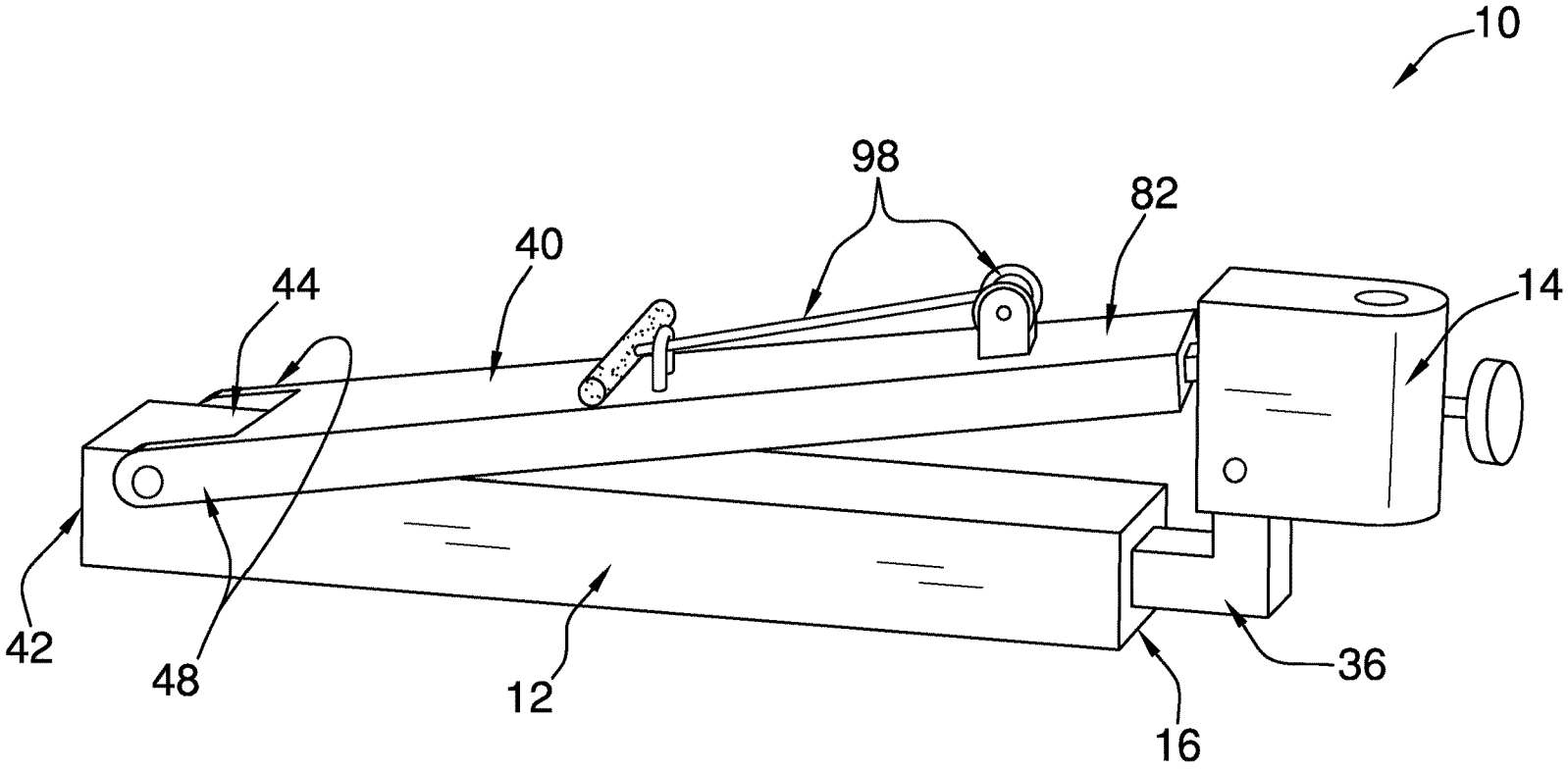
FIG. 1 is an isometric perspective view of a trolling motor mounting assembly according to an embodiment of the disclosure.
Figure 2:
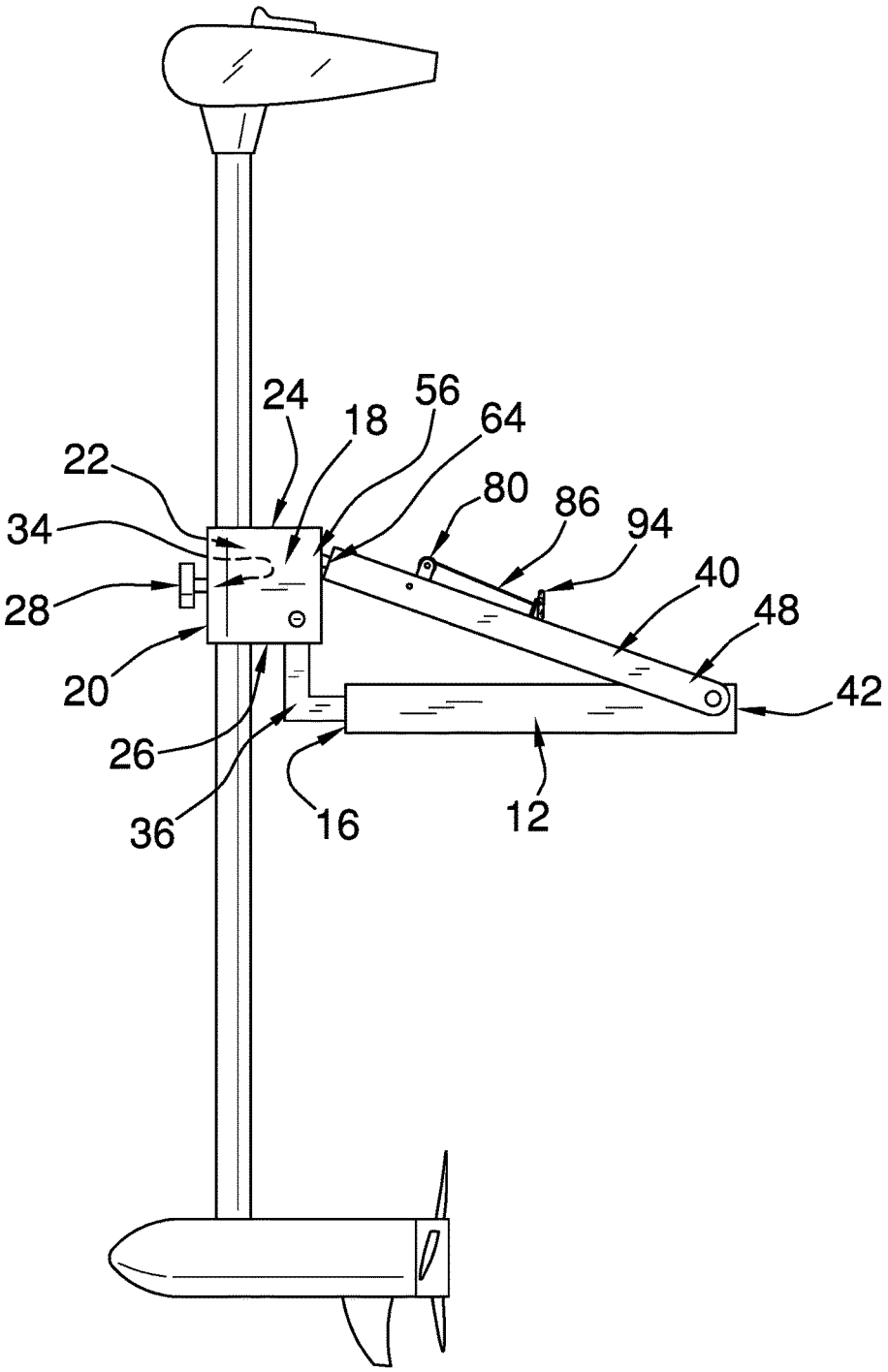
FIG. 2 is a side view of an embodiment of the disclosure.
Figure 3:
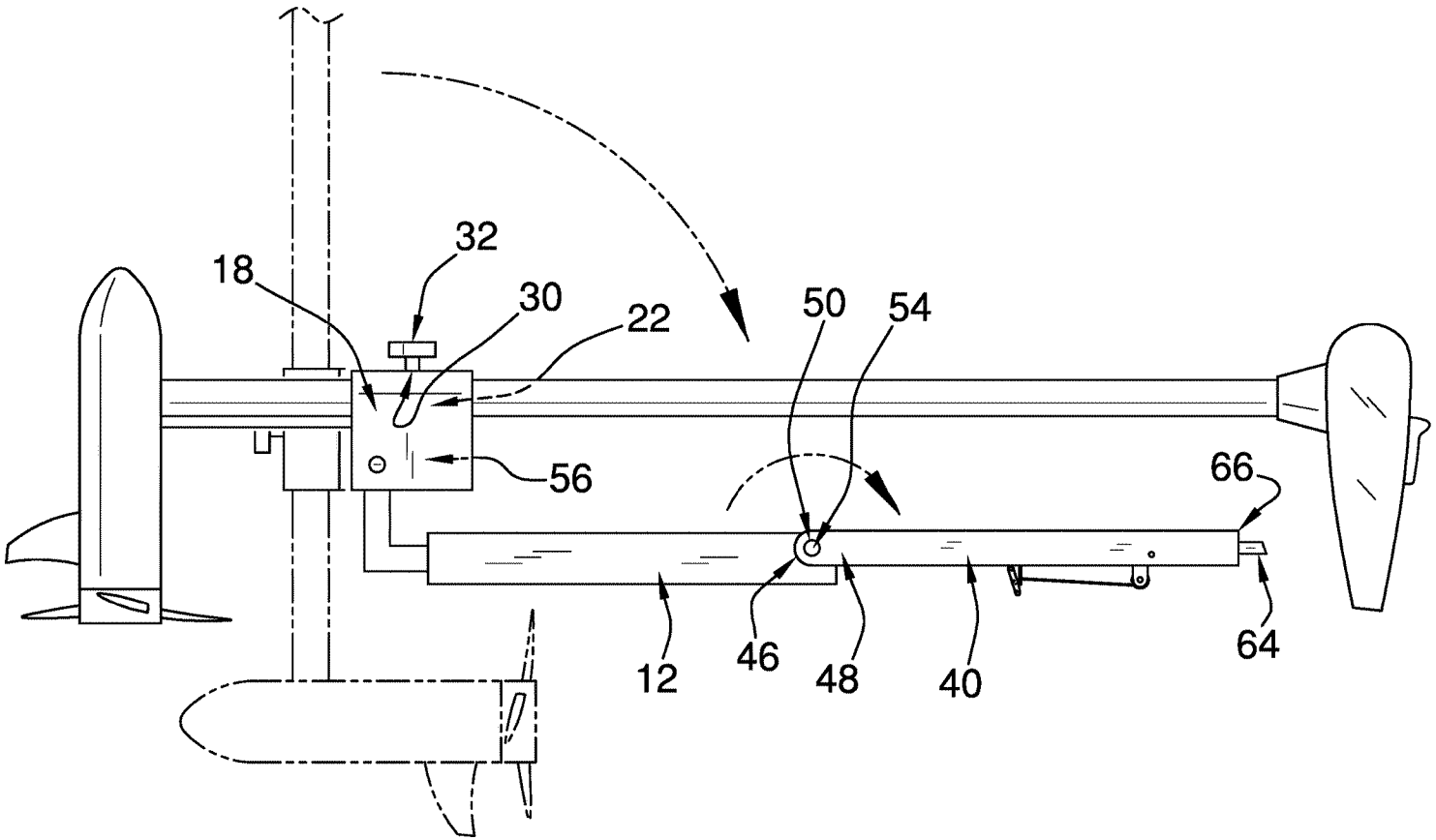
FIG. 3 is a side view of an embodiment of the disclosure.
Figure 4:
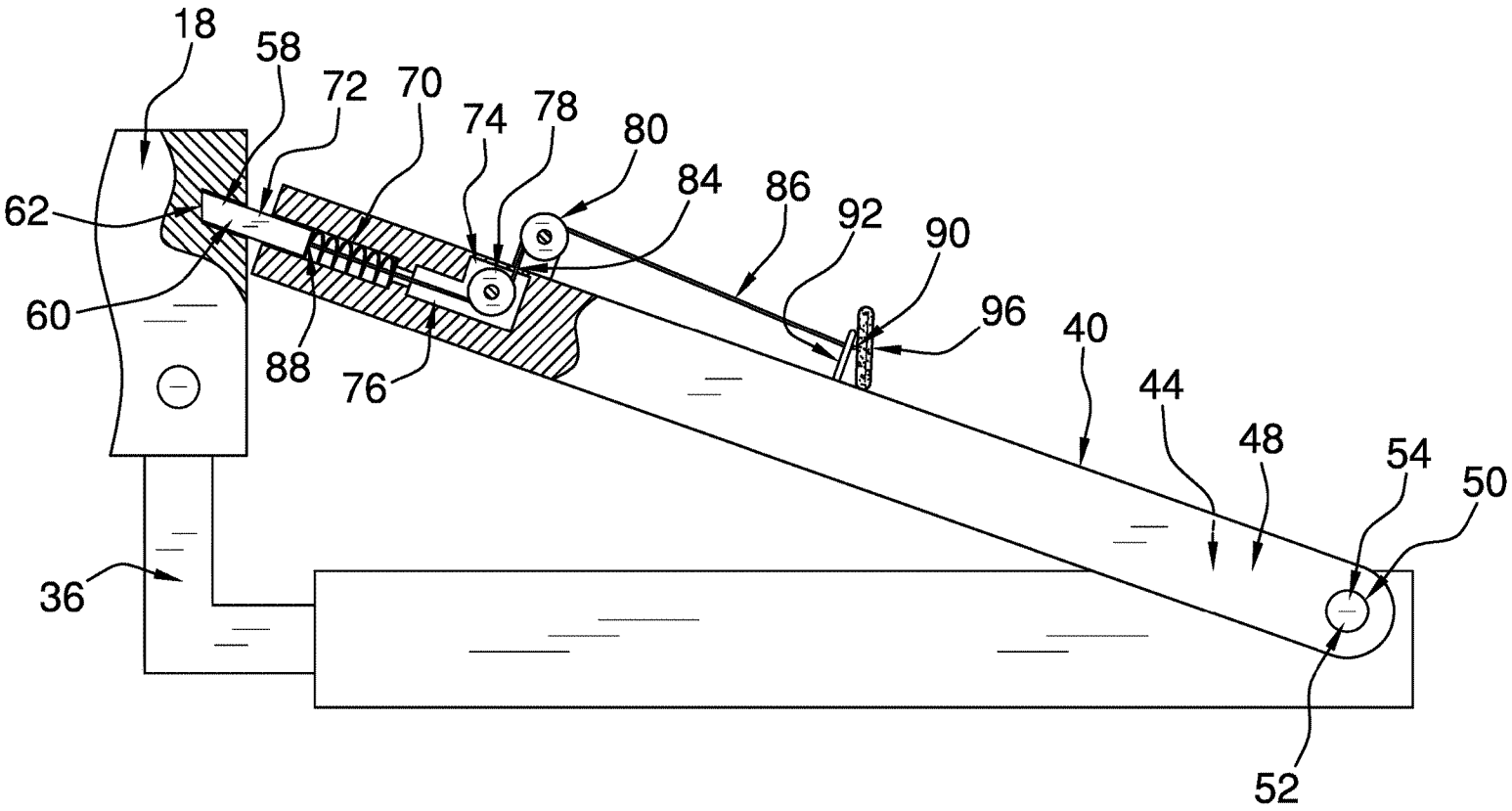
FIG. 4 is a detail view of an embodiment of the disclosure.
Figure 5:
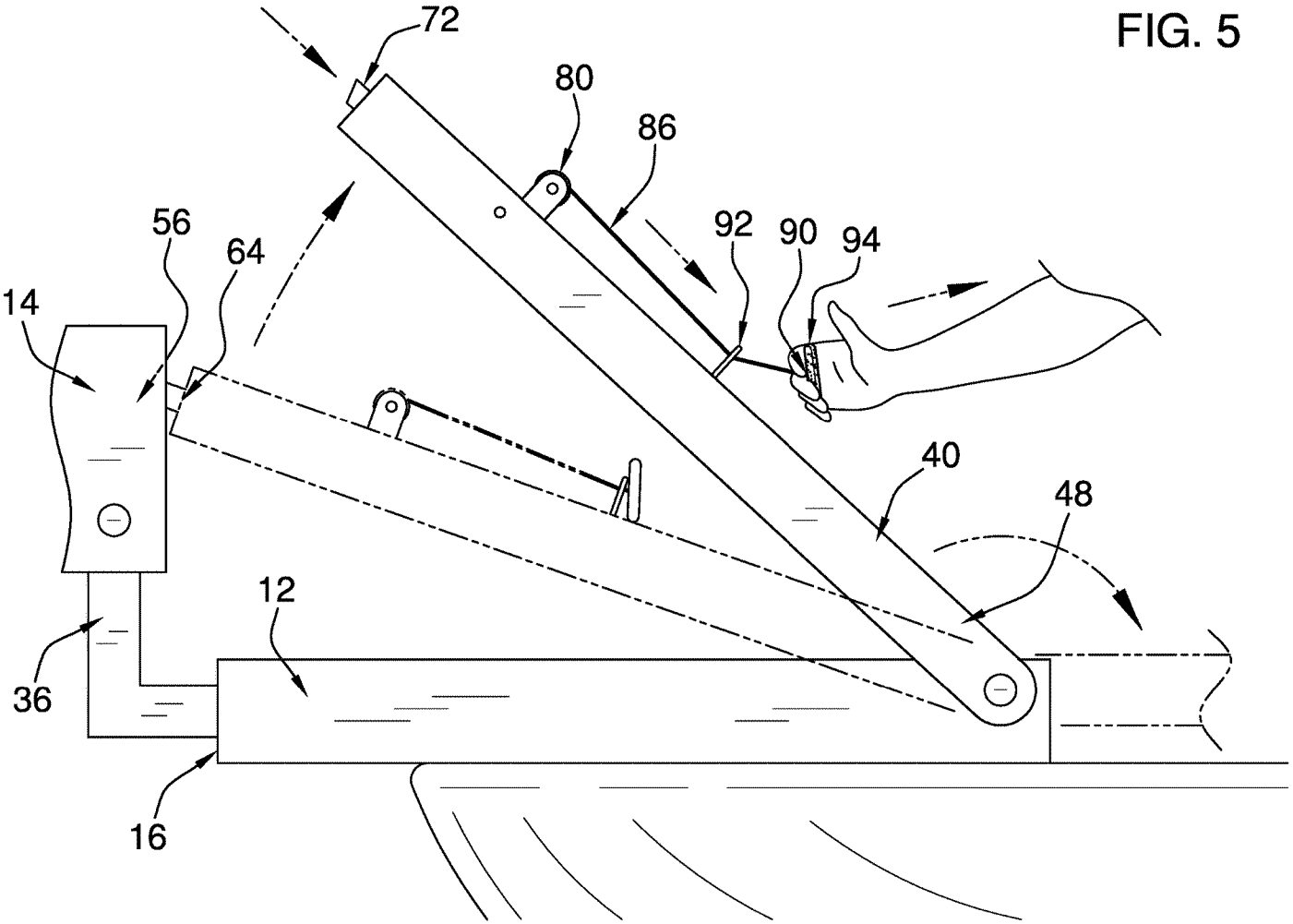
FIG. 5 is an in-use view of an embodiment of the disclosure.

With reference now to the drawings, and in particular to FIGS. 1 through 5 thereof, a new mounting assembly embodying the principles and concepts of an embodiment of the disclosure and generally designated by the reference numeral 10 will be described.

As best illustrated in FIGS. 1 through 5, the trolling motor mounting assembly 10 generally comprises a base 12 that is configured to couple to a boat. In one embodiment, the base 12 is substantially rectangularly box shaped.

A connector 14 is hingedly coupled to a first end 16 of the base 12. The connector 14 is configured to selectively couple to a shaft of a trolling motor. In one embodiment, the connector 14 comprises a housing 18. In another embodiment, the housing 18 is substantially rectangularly box shaped. In yet another embodiment, the housing 18 has a front 20 that is arcuate.

A first channel 22 is positioned through the housing 18. The first channel 22 extends from a top 24 to a bottom 26 of the housing 18. The channel is substantially complementary to the shaft of the trolling motor. The first channel 22 is configured to insert the shaft of the trolling motor to slidably couple the connector 14 to the shaft.

A coupler 28 is coupled to the front 20 of the housing 18. The coupler 28 is configured to selectively couple to the shaft of the trolling motor to fixedly position the connector 14 on the shaft. In one embodiment, the coupler 28 comprises an orifice 30 and a thumbscrew 32. The orifice 30 is positioned in the front 20 of the housing 18. The orifice 30 extends to the first channel 22 and is threaded. The thumbscrew 32 is complementary to the orifice 30. The orifice 30 is positioned to threadedly insert the thumbscrew 32 so that a terminus 34 of the thumbscrew 32 is positioned to frictionally couple to the shaft to fixedly couple the connector 14 to the shaft.

In one embodiment, a rod 36 is coupled to and extends from the first end 16 of the base 12. The rod 36 is hingedly coupled to the bottom 26 of the housing 18 proximate to a back 38 of the housing 18. The rod 36 is L-shaped.

A bar 40 is hingedly coupled to the base 12 proximate to a second end 42 of the base 12. In one embodiment, the bar 40 is substantially rectangularly box shaped. A notch 44 extends into the bar 40 from a first endpoint 46 of the bar 40 and defines a pair of arms 48. The notch 44 is complementary to the base 12. The notch 44 is positioned to insert the base 12.

Each of a pair of penetrations 50 is positioned through a respective arm 48 distal from the bar 40. A second channel 52 is positioned through the base 12 proximate to the second end 42. The second channel 52 is complementary to the penetrations 50. A first pin 54 is positioned through the penetrations 50 and the second channel 52 so that the bar 40 is pivotally coupled to the base 12.

A first fastener 56 is coupled to the connector 14. In one embodiment, the first fastener 56 comprises a third channel 58 that extends angularly into the housing 18 from the back 38 of the housing 18. An opening 60 of the third channel 58 is positioned closer to the bottom 26 of the housing 18 than an endpoint 62 of the third channel 58. In one embodiment, the third channel 58 is substantially circularly shaped when viewed longitudinally.

A second fastener 64 is coupled to a second endpoint 66 of the bar 40. The second fastener 64 is complementary to the first fastener 56. In another embodiment, the second fastener 64 comprises a fourth channel 68 that extends into the bar 40 from the second endpoint 66 of the bar 40. A spring 70 is coupled to the bar 40 and is positioned in the fourth channel 68. A second pin 72 is coupled to the spring 70. The spring 70 is positioned to compel the second pin 72 to protrude from the bar 40 to insert into the third channel 58 to couple the bar 40 to the connector 14. In yet another embodiment, the endpoint 62 of the third channel 58 is tapered. The second pin 72 is tapered distal from the spring 70 so that the second pin 72 is complementary to the endpoint 62 of the third channel 58.

An actuator 98 is coupled to the bar 40. The actuator 98 is operationally coupled to the second fastener 64. The bar 40 is positioned to pivot so that the bar 40 extends transversely from the base 12. The second fastener 64 is positioned to couple to the first fastener 56 to fixedly position the shaft in a substantially vertical configuration. The actuator 98 is positioned to compel the second fastener 64 to decouple from the first fastener 56. The bar 40 is positioned to pivot so that the bar 40 extends substantially coplanarly from the base 12. The connector 14 is positioned to pivot so that the shaft is substantially parallel to the base 12 and the bar 40.

In one embodiment, the actuator 98 comprises a cavity 74 that is positioned within the bar 40. A fifth channel 76 extends from the cavity 74 to the fourth channel 68. A first pulley 78 is coupled to the bar 40 and is positioned within the cavity 74. A second pulley 80 is coupled to an upper face 82 of the bar 40 proximate to the cavity 74. A hole 84 is positioned in the upper face 82 of the bar 40 proximate to the second pulley 80. The hole 84 extends to the cavity 74. A cord 86 is coupled by a first terminus 88 to the spring 70 adjacent to the second pin 72. The cord 86 extends through the spring 70, the fifth channel 76, the cavity 74, and the hole 84 so that a second terminus 90 of the cord 86 extends from the bar 40. The cord 86 is operationally coupled to the first pulley 78 and the second pulley 80. The second terminus 90 of the cord 86 is configured to be grasped and pulled to compel the spring 70 to compress to extract the second pin 72 from the third channel 58 to selectively decouple the bar 40 from the connector 14.

A ring 92 is coupled to the upper face 82 of the bar 40 substantially equally distant from the first endpoint 46 and the second endpoint 66 of the bar 40. The cord 86 extends from the second pulley 80 through the ring 92. A handle 94 is coupled to the second terminus 90 of the cord 86. The handle 94 is configured to be grasped in a hand of a user to pull the cord 86. The ring 92 is positioned to retain the handle 94 and the cord 86 on the upper face 82 of the bar 40. In one embodiment, the handle 94 comprises a dowel 96.

In use, the orifice 30 is positioned to threadedly insert the thumbscrew 32 to fixedly couple the connector 14 to the shaft. The bar 40 is positioned to pivot so that the bar 40 extends transversely from the base 12. The spring 70 is positioned to compel the second pin 72 to protrude from the bar 40 to insert into the third channel 58 to couple the bar 40 to the connector 14. The shaft is fixedly positioned in a substantially vertical configuration. The cord 86 is positioned on the spring 70 so that the handle 94 is configured to be grasped and pulled to compel the spring 70 to compress to extract the second pin 72 from the third channel 58 to selectively decouple the bar 40 from the connector 14. The bar 40 is positioned to pivot so that the bar 40 extends substantially coplanarly from the base 12. The connector 14 is positioned to pivot so that the shaft is substantially parallel to the base 12 and the bar 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A trolling motor mounting assembly comprising:

a base configured for coupling to a boat;

a connector hingedly coupled to a first end of said base, said connector being configured for selectively coupling to a shaft of a trolling motor;

a bar hingedly coupled to said base proximate to a second end of said base;

a first fastener coupled to said connector;

a second fastener coupled to a second endpoint of said bar, said second fastener being complementary to said first fastener;

an actuator coupled to said bar, said actuator being operationally coupled to said second fastener; and wherein said bar is positioned on said base such that said bar is configured to pivot in a first position where said bar extends transversely from said base for positioning said second fastener for coupling to said first fastener for fixedly positioning the shaft in a substantially vertical configuration, wherein said actuator is positioned on said bar such that said actuator is positioned for urging said second fastener for decoupling from said first fastener such that said bar is configured to pivot in a second position where said bar extends substantially coplanarly from said base, wherein said connector is positioned on said base such that said connector is positioned for pivoting such that the shaft is substantially parallel to said base and said bar.

2. The assembly of claim 1, further including said base being substantially rectangularly box shaped.

3. The assembly of claim 1, further including said connector comprising:

a housing;

a first channel positioned through said housing, said first channel extending from a top to a bottom of said housing, said channel being substantially complementary to the shaft of the trolling motor, wherein said first channel is positioned through said housing such that said first channel is configured for inserting the shaft of the trolling motor for slidably coupling said connector to the shaft; and a coupler coupled to a front of said housing, said coupler being configured for selectively coupling to the shaft of the trolling motor for fixedly positioning said connector on the shaft.

4. The assembly of claim 3, further including said housing being substantially rectangularly box shaped.

5. The assembly of claim 4, further including said housing having said front, said front being arcuate.

6. The assembly of claim 3, further including said coupler comprising:

an orifice positioned in said front of said housing, said orifice extending to said first channel, said orifice being threaded;

a thumbscrew complementary to said orifice; and wherein said orifice is positioned in said housing such that said orifice is positioned for threadedly inserting said thumbscrew such that a terminus of said thumbscrew is positioned for frictionally coupling to the shaft for fixedly coupling said connector to the shaft.

7. The assembly of claim 3, further including a rod coupled to and extending from said first end of said base, said rod being hingedly coupled to said bottom of said housing proximate to a back of said housing, said rod being L-shaped.

8. The assembly of claim 1, further including said bar being substantially rectangularly box shaped.

9. The assembly of claim 1, further comprising:

a notch extending into said bar from a first endpoint of said bar defining a pair of arms, said notch being complementary to said base, wherein said notch is positioned in said bar such that said notch positioned for inserting said base;

a pair of penetrations, each said penetration being positioned through a respective arm of said pair of arms distal from said bar;

a second channel positioned through said base proximate to said second end, said second channel being complementary to said penetrations;

a first pin positioned through said penetrations and said second channel such that said bar is pivotally coupled to said base.

10. The assembly of claim 1, further comprising:

said first fastener comprising a third channel extending angularly into a housing from a back of said housing such that an opening of said third channel is positioned closer to a bottom of said housing than an endpoint of said third channel, said third channel being substantially circularly shaped when viewed longitudinally;

said second fastener comprising:

a fourth channel extending into said bar from said second endpoint of said bar, a spring coupled to said bar and positioned in said fourth channel, and a second pin coupled to said spring; and wherein said second pin is positioned on said spring such that said spring is positioned for urging said second pin for protruding from said bar for inserting into said third channel for coupling said bar to said connector.

11. The assembly of claim 10, further including said endpoint being tapered, said second pin being tapered distal from said spring such that said second pin is complementary to said endpoint of said third channel.

12. The assembly of claim 10, further including said actuator comprising:

a cavity positioned within said bar;

a fifth channel extending from said cavity to said fourth channel;

a first pulley coupled to said bar and positioned within said cavity;

a second pulley coupled to an upper face of said bar proximate to said cavity;

a hole positioned in said upper face of said bar proximate to said second pulley, said hole extending to said cavity;

a cord coupled by a first terminus to said spring adjacent to said second pin, said cord extending through said spring, said fifth channel, said cavity, and said hole such that a second terminus of said cord extends from said bar, said cord being operationally coupled to said first pulley and said second pulley; and wherein said cord is positioned on said spring such that said second terminus of said cord is configured for grasping and pulling for urging said spring for compressing for extracting said second pin from said third channel for selectively decoupling said bar from said connector.

13. The assembly of claim 12, further comprising:

a ring coupled to said upper face of said bar substantially equally distant from a first endpoint and said second endpoint of said bar, said cord extending from said second pulley through said ring;

a handle coupled to said second terminus of said cord; and wherein said handle is positioned on said cord such that said handle is configured for grasping in a hand of a user for pulling said cord, wherein said ring is positioned on said bar such that said ring is positioned for retaining said handle and said cord on said upper face of said bar, said handle comprising a dowel.

14. A trolling motor mounting assembly comprising:

a base configured for coupling to a boat, said base being substantially rectangularly box shaped;

a connector hingedly coupled to a first end of said base, said connector being configured for selectively coupling to a shaft of a trolling motor, said connector comprising:

a housing, said housing being substantially rectangularly box shaped, said housing having a front, said front being arcuate, a first channel positioned through said housing, said first channel extending from a top to a bottom of said housing, a channel being substantially complementary to the shaft of the trolling motor, wherein said first channel is positioned through said housing such that said first channel is configured for inserting the shaft of the trolling motor for slidably coupling said connector to the shaft, and a coupler coupled to said front of said housing, said coupler being configured for selectively coupling to the shaft of the trolling motor for fixedly positioning said connector on the shaft, said coupler comprising:

an orifice positioned in said front of said housing, said orifice extending to said first channel, said orifice being threaded, and a thumbscrew complementary to said orifice, wherein said orifice is positioned in said housing such that said orifice is positioned for threadedly inserting said thumbscrew such that a terminus of said thumbscrew is positioned for frictionally coupling to the shaft for fixedly coupling said connector to the shaft;

a rod coupled to and extending from a first end of said base, said rod being hingedly coupled to said bottom of said housing proximate to a back of said housing, said rod being L-shaped;

a bar hingedly coupled to said base proximate to a second end of said base, said bar being substantially rectangularly box shaped;

a notch extending into said bar from a first endpoint of said bar defining a pair of arms, said notch being complementary to said base, wherein said notch is positioned in said bar such that said notch positioned for inserting said base;

a pair of penetrations, each said penetration being positioned through a respective arm of said pair of arms distal from said bar;

a second channel positioned through said base proximate to said second end, said second channel being complementary to said penetrations;

a first pin positioned through said penetrations and said second channel such that said bar is pivotally coupled to said base;

a first fastener coupled to said connector, said first fastener comprising a third channel extending angularly into said housing from said back of said housing such that an opening of said third channel is positioned closer to said bottom of said housing than an endpoint of said third channel, said third channel being substantially circularly shaped when viewed longitudinally, said endpoint being tapered;

a second fastener coupled to a second endpoint of said bar, said second fastener being complementary to said first fastener, said second fastener comprising:

a fourth channel extending into said bar from said second endpoint of said bar, a spring coupled to said bar and positioned in said fourth channel, and a second pin coupled to said spring, wherein said second pin is positioned on said spring such that said spring is positioned for urging said second pin for protruding from said bar for inserting into said third channel for coupling said bar to said connector, said second pin being tapered distal from said spring such that said second pin is complementary to said endpoint of said third channel;

an actuator coupled to said bar, said actuator being operationally coupled to said second fastener, wherein said bar is positioned on said base such that said bar is positioned for pivoting such that said bar extends transversely from said base for positioning said second fastener for coupling to said first fastener for fixedly positioning the shaft in a substantially vertical configuration, wherein said actuator is positioned on said bar such that said actuator is positioned for urging said second fastener for decoupling from said first fastener such that said bar is positioned for pivoting such that said bar extends substantially coplanarly from said base, wherein said connector is positioned on said base such that said connector is positioned for pivoting such that the shaft is substantially parallel to said base and said bar, said actuator comprising:

a cavity positioned within said bar, a fifth channel extending from said cavity to said fourth channel, a first pulley coupled to said bar and positioned within said cavity, a second pulley coupled to an upper face of said bar proximate to said cavity, a hole positioned in said upper face of said bar proximate to said second pulley, said hole extending to said cavity, and a cord coupled by a first terminus to said spring adjacent to said second pin, said cord extending through said spring, said fifth channel, said cavity, and said hole such that a second terminus of said cord extends from said bar, said cord being operationally coupled to said first pulley and said second pulley, wherein said cord is positioned on said spring such that said second terminus of said cord is configured for grasping and pulling for urging said spring for compressing for extracting said second pin from said third channel for selectively decoupling said bar from said connector;

a ring coupled to said upper face of said bar substantially equally distant from said first endpoint and said second endpoint of said bar, said cord extending from said second pulley through said ring;

a handle coupled to said second terminus of said cord, wherein said handle is positioned on said cord such that said handle is configured for grasping in a hand of a user for pulling said cord, wherein said ring is positioned on said bar such that said ring is positioned for retaining said handle and said cord on said upper face of said bar, said handle comprising a dowel; and wherein said orifice is positioned in said housing such that said orifice is positioned for threadedly inserting said thumbscrew such that said terminus of said thumbscrew is configured for frictionally coupling to the shaft for fixedly coupling said connector to the shaft, wherein said bar is positioned on said base such that said bar is configured to pivot in a first position where said bar extends transversely from said base such that said spring is positioned for urging said second pin for protruding from said bar for inserting into said third channel for coupling said bar to said connector for fixedly positioning the shaft in said substantial vertical configuration, wherein said cord is positioned on said spring such that said handle is configured for grasping and pulling for urging said spring for compressing for extracting said second pin from said third channel for selectively decoupling said bar from said connector such that said bar is configured to pivot in a second position where said bar extends substantially coplanarly from said base, wherein said connector is positioned on said base such that said connector is positioned for pivoting such that the shaft is substantially parallel to said base and said bar.

* * * * *